US007735800B2

(12) United States Patent
Lunato et al.

(10) Patent No.: US 7,735,800 B2
(45) Date of Patent: Jun. 15, 2010

(54) ADAPTABLE PLANTER MOUNTING SYSTEM

(75) Inventors: Victoria A. Lunato, Maitland, FL (US); Gary V. Hoffman, Ramona, CA (US); Timothy J. Brunette, Suttons Bay, MI (US)

(73) Assignee: Fiskars Brands, Inc., Madison, WI (US)

( * ) Notice: Subject to any disclaimer, the term of this patent is extended or adjusted under 35 U.S.C. 154(b) by 560 days.

(21) Appl. No.: 11/811,298

(22) Filed: Jun. 8, 2007

(65) Prior Publication Data

US 2008/0302943 A1 Dec. 11, 2008

(51) Int. Cl.
*F16M 13/00* (2006.01)

(52) U.S. Cl. ..... 248/558; 47/39; 47/68; 248/27.8; 248/146

(58) Field of Classification Search ..... 248/558, 248/27.8, 146, 175; 47/39, 68
See application file for complete search history.

(56) References Cited

U.S. PATENT DOCUMENTS

| | | | | |
|---|---|---|---|---|
| 4,074,461 | A | | 2/1978 | Hirschman |
| 4,561,208 | A | | 12/1985 | Schultz |
| 5,065,971 | A | | 11/1991 | Gaube |
| 5,368,266 | A | | 11/1994 | Allen |
| 5,368,267 | A | * | 11/1994 | Howard ..... 248/231.41 |
| 5,564,226 | A | | 10/1996 | Paramest |
| 5,606,824 | A | | 3/1997 | Ruibal |
| 5,822,918 | A | * | 10/1998 | Helfman et al. ..... 47/39 |
| 5,860,370 | A | | 1/1999 | Poniecki |
| 6,050,532 | A | | 4/2000 | Paul |
| 6,170,144 | B1 | | 1/2001 | Phillipson |
| 6,230,437 | B1 | | 5/2001 | Wolverton et al. |
| 6,393,764 | B1 | | 5/2002 | Smith |
| 6,398,174 | B1 | | 6/2002 | Emalfarb |
| 6,510,653 | B1 | | 1/2003 | Workum et al. |
| 6,520,354 | B1 | * | 2/2003 | Skvorecz ..... 211/181.1 |
| 6,659,412 | B1 | | 12/2003 | Roach |
| 6,854,210 | B2 | | 2/2005 | Gunderman |
| D512,339 | S | | 12/2005 | Talmadge |
| D513,206 | S | | 12/2005 | Talmadge |
| D514,018 | S | | 1/2006 | Talmadge |

* cited by examiner

*Primary Examiner*—J. Allen Shriver, II
*Assistant Examiner*—Bradley H Duckworth
(74) *Attorney, Agent, or Firm*—Foley & Lardner LLP

(57) ABSTRACT

An adaptable planter mounting system includes a holder having a platform and at least one pair of arms configured to support a planter. The platform and at least one of the arms are provided with apertures. At least one pair of brackets are adjustably and removably attachable to the platform and the arms to provide a variety of mounting arrangements including a post-top mounting arrangement, a rail mounting arrangement, and a wall-top mounting arrangement.

19 Claims, 8 Drawing Sheets

ADAPTABLE PLANTER MOUNTING SYSTEM

FIELD

The present invention relates to a mounting system for a planter. The present invention relates more particularly to an adaptable mounting system for a planter that is configurable for mounting on a wide variety of structures.

BACKGROUND

It is generally known to provide a mounting arrangement for containers such as planters used for containing, displaying and/or growing plants such as flowers, herbs, and the like, for mounting on a particular structure.

Such mounting arrangements typically involve direct fastening of the planter to structure (e.g. by screws, nails, etc.) or suspending/hanging the planter by hooks, chains, cables or other suitable hardware. However, such conventional mounting arrangements tend not to be readily adaptable for interchangeably mounting a planter on a wide variety of structures. For example, direct fastening of a planter to a structure is usually a permanent or semi-permanent installation and often requires extensive effort to remove the planter from the structure for reinstallation on another structure or location, often involving new or different hardware and leaving unsightly screw holes or other undesirable damage to the planter. By further way of example, suspending or hanging a planter by hooks, chains, etc. from an overhead structure, while permitting movement of the planter to other overhead structures, usually does not provide a readily adaptable way of mounting the planter on other non-overhead type structures and in other mounting configurations, such as wall-top mounts, post-top mounts, railing/fence mounts, corner-mounts, step-mount, etc.

Accordingly, it would be desirable to provide an adaptable mounting system for a planter that is readily and interchangeably attachable to various structures in a wide variety of mounting arrangements. It would also be desirable to provide an adaptable mounting system for a planter that includes a holder for supporting the planter, and reconfigurable brackets that are attachable to the holder in a variety of locations and orientations. It would be further desirable to provide an adaptable mounting system for a planter that is capable of mounting the planter in any one or more of the following mounting arrangements: post-top, wall-top, rail-top, rail-hang, and corner-top.

Accordingly, it would be desirable to provide an adaptable mounting system for a planter having any one or more of these or other desirable features.

SUMMARY

According to one embodiment, an adaptable planter mounting system includes a holder. The holder includes first and second U shaped supports configured to support a planter. Each U shaped support has a substantially horizontal base with apertures, and first and second arms extending upwardly from opposite ends of the base, with at least one of the arms having apertures. A first elongated member interconnects the first arms of the U shaped supports and a second elongated member interconnects the second arms of the U shaped supports. A platform interconnects the bases of the U shaped holders and includes a plurality of apertures. First and second L shaped brackets each having a first leg and a second leg are also provided. The first legs of the brackets each have an elongated aperture that is aligned with at least one of the apertures on the base, the platform, or the arms to adjustably and removably connect the first and second L shaped brackets to the holder, so that holder is configured for mounting on a support structure.

According to another embodiment, an adaptable planter mounting system includes a holder and at least two L shaped brackets. The holder includes spaced apart first and second U shaped supports configured to support a planter. Each U shaped support has a substantially horizontal base with apertures, and first and second arms extending upwardly from the base, at least one of the arms has apertures. The holder also includes a first elongated member interconnecting the first arms, and a platform interconnecting the bases of the U shaped supports. The platform includes a central V shaped region and a plurality of apertures. The L shaped brackets each have a first leg and a second leg, at least one of the legs for each bracket having an elongated aperture formed therein, the elongated aperture being aligned with at least one of the apertures on the base, or the platform, or the arms to adjustably and removably connect the L shaped brackets to the holder, so that holder is configured for mounting on a support structure.

According to a further embodiment, an adaptable planter mounting system includes a holder having a platform and at least one pair of arms configured to support the planter. The platform and at least one of the arms include apertures. The system also includes at least one pair of brackets adjustably and removably attachable to the platform and the arms to provide a plurality of mounting arrangements including a stepped mounting arrangement, a rail mounting arrangement, and a wall-top mounting arrangement.

DETAILED DESCRIPTION

Referring to the FIGURES, an adaptable mounting system for a container (such as a planter, flowerbox, or the like) is provided for interchangeably mounting the planter on a wide variety of structures and in a wide variety of arrangements and orientations. The mounting system is shown to include a holder and reconfigurable brackets. The holder is shown having a frame intended to support and secure the planter within the holder, and includes features for adjustably receiving the brackets for attachment to the holder. The configuration of the brackets and their variable attachment location on the holder provide a wide variety of mounting arrangements shown for example to include post-top, wall-top (longitudinal), wall-top (transverse), rail-top, rail-hang, corner-mount, and step-mount. However, the configuration of the brackets, the structure of the holder, and the mounting arrangements as illustrated in the FIGURES are shown by way of example, and any of a wide variety of other bracket shapes, holder structures and mounting arrangements will be readily apparent to a person of ordinary skill in the art after reviewing this disclosure. All such variations are intended to be within the scope of the invention.

Figure 1:
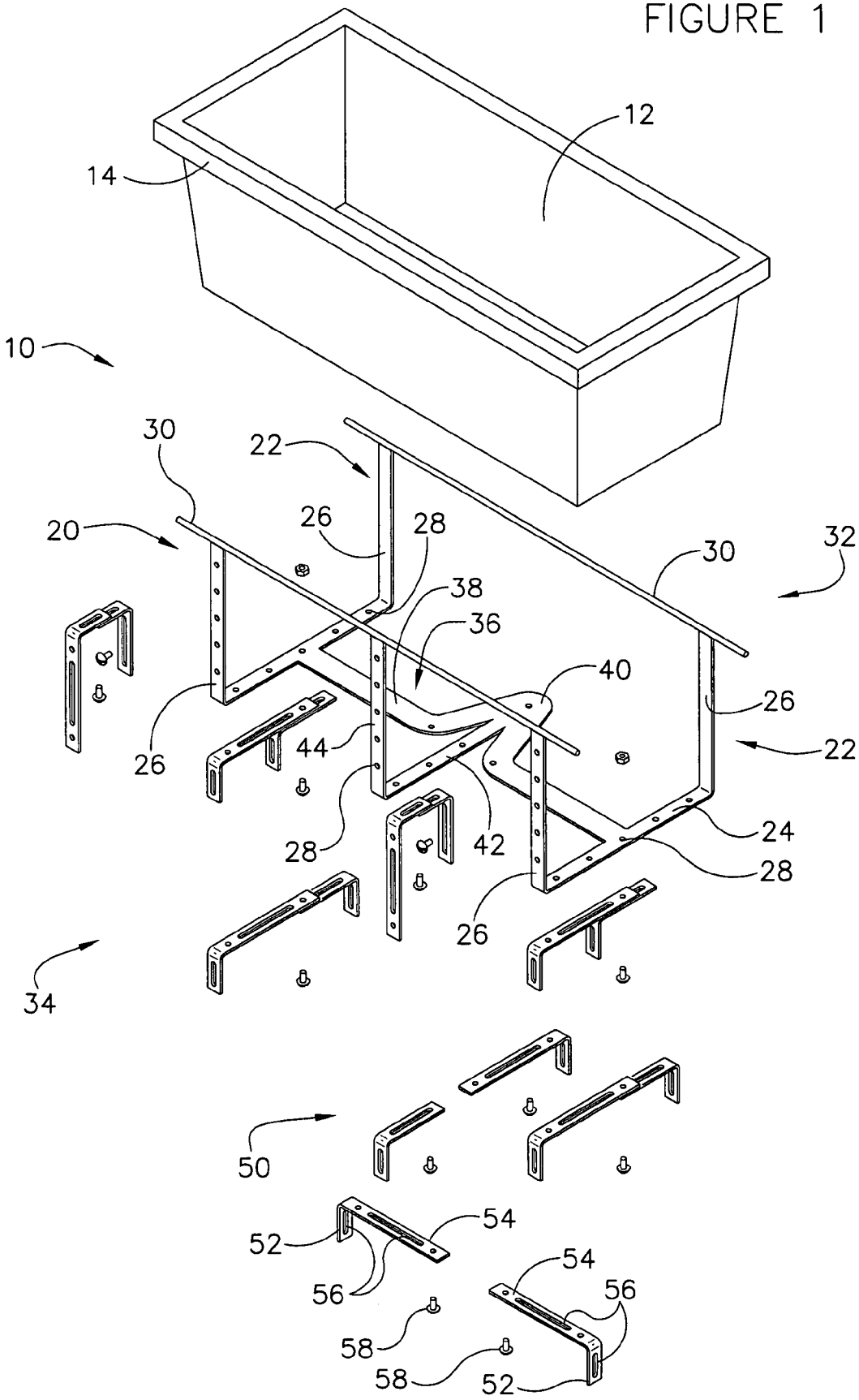
FIG. 1 is a schematic image of an exploded perspective view of an adaptable planter mounting system according to an exemplary embodiment.

Referring to FIG. 1, an adaptable mounting system 10 for a planter 12 is shown according to an exemplary embodiment. The system 10 is shown to include a holder 20 and brackets 50. The holder 20 is shown as a structure in the form of a frame intended to at least partially surround the planter 12 to support and secure the planter when the holder and brackets are configured in a mounting arrangement for use with a structure (e.g. a wall, a rail, a fence, a post, etc.).

Referring further to FIG. 1, the holder 20 is shown to include a pair of U shaped supports 22 having a substantially horizontal base 24 extending transverse to a longitudinal axis of the holder, and substantially vertical arms 26 extending upwardly from opposite sides of the base 24. Although the base is shown as a horizontal member for supporting a planar horizontal underside of a planter, the base may have any desirable shape or contour to match the underside of any type of planter. Each base 24 and at least one arm 26 of each U shaped support 22 are provided with a series of apertures 28 (shown for example as circular holes, but may be slots or other suitable apertures), configured to align with the brackets 50. Each arm 26 is also shown connected to an elongated member 30 (e.g. bar, rail, rod, strip, strap, etc.) extending parallel to a longitudinal axis of the holder 20, with one elongated member 30 extending along a front side 32 and one elongated member 30 extending along a back side 34. The elongated members 30 are shown at a common height above the bases 24 and coplanar with one another, but may be offset, sloped, or have any other arrangement (such as omitted entirely) for retaining the planter 12 within the holder 20. According to one embodiment, the elongated members 30 may be arranged to be "hidden" or otherwise concealed or nested within or beneath a lip, ledge or overhang 14 along a back and/or front side of the planter 12. According to an alternative embodiment, the ends of the elongated members may be joined together by transverse members to provide a "ring" that substantially surrounds a perimeter of the planter.

Referring further to FIG. 1, the bases 24 of each U shaped support 22 are connected to one another through a substantially horizontal platform section 36 that is shown in a coplanar relationship with each base 24. Platform 36 is shown for example to include a base 38 intended to provide support to an underside of the planter, and having apertures 28 (shown for example as circular holes, but may be slots or other suitable apertures), configured to align with the brackets 50. Platform 36 is also shown to include an extension intended to enhance stability (shown by way of example as a V shaped region 40) located at a mid-section of the platform 36. According to one embodiment, V shaped region 40 may be particularly advantageous in mounting arrangements for use with post-tops (see FIG. 6) and corner-mounts (see FIG. 8). According to the illustrated embodiment, an additional base 42 and arm 44 may be included and integrated with the platform extension (shown as a V shaped region 40) of the platform 36, to provide additional rigidity and/or stability to the system. The holder may be made of any suitable material having sufficient strength for mounting the planter, and the capability to resist degradation due to the weather and other environmental conditions. For example, the holder may be formed from aluminum, or steel and may be provided with a suitable coating (e.g. zinc, cadmium, plastic, rubber, etc.).

Referring further to FIG. 1, brackets 50 are shown according to an exemplary embodiment for use in securing the holder to a structure. Brackets 50 are shown for example as L shaped brackets having a first leg 52 and a second leg 54, each leg having apertures 56 (shown as circular holes and slots), and with the second leg 54 longer than the first leg 52. According to an alternative embodiment, the brackets may be provided in any desirable shape, with legs of any suitable length and with any desirable type and arrangement of apertures configured to receive fasteners 58 for connecting the brackets to one another and to the holder. The slots provided in the legs are intended to permit adjustment of the position of the brackets relative to one another, and relative to the arms, base and platform of the holder, so that connection of the brackets to the holder and/or to one another provide a variably configurable system for creating a wide variety of mounting arrangements for securing a planter to a structure. The brackets may be made of any suitable material having sufficient strength for mounting the planter, and the capability to resist degradation due to the weather and other environmental conditions. For example, the brackets may be formed from aluminum, or steel and may be provided with a suitable coating (e.g. zinc, cadmium, plastic, rubber, etc.).

Referring to FIGS. 2-8, the brackets 50 are shown to be removably and adjustably connected to the holder 20 and (in some instances) to one another by fasteners to provide a variety of readily adaptable mounting arrangements for use with different types of structures. According to an alternative embodiment, the bracket configurations and the mounting arrangements of the brackets and holder shown for example in FIGS. 2-8 may be provided by brackets that slidably engage and/or snap-connect to one another and to the holder to provide an adjustable, "fastener-less" system. For example, the arms and the platform of the holder may contain slots, tracks or rails sized and shaped to slidably receive the legs of the brackets, and the legs may be provided with nubs, ribs, detents, etc. arranged to engage notches or other suitable structure in the tracks in an interference type relationship to secure the brackets in place until overcome by a predetermined, suitable level of force intended to reposition or remove the brackets.

Figure 2:
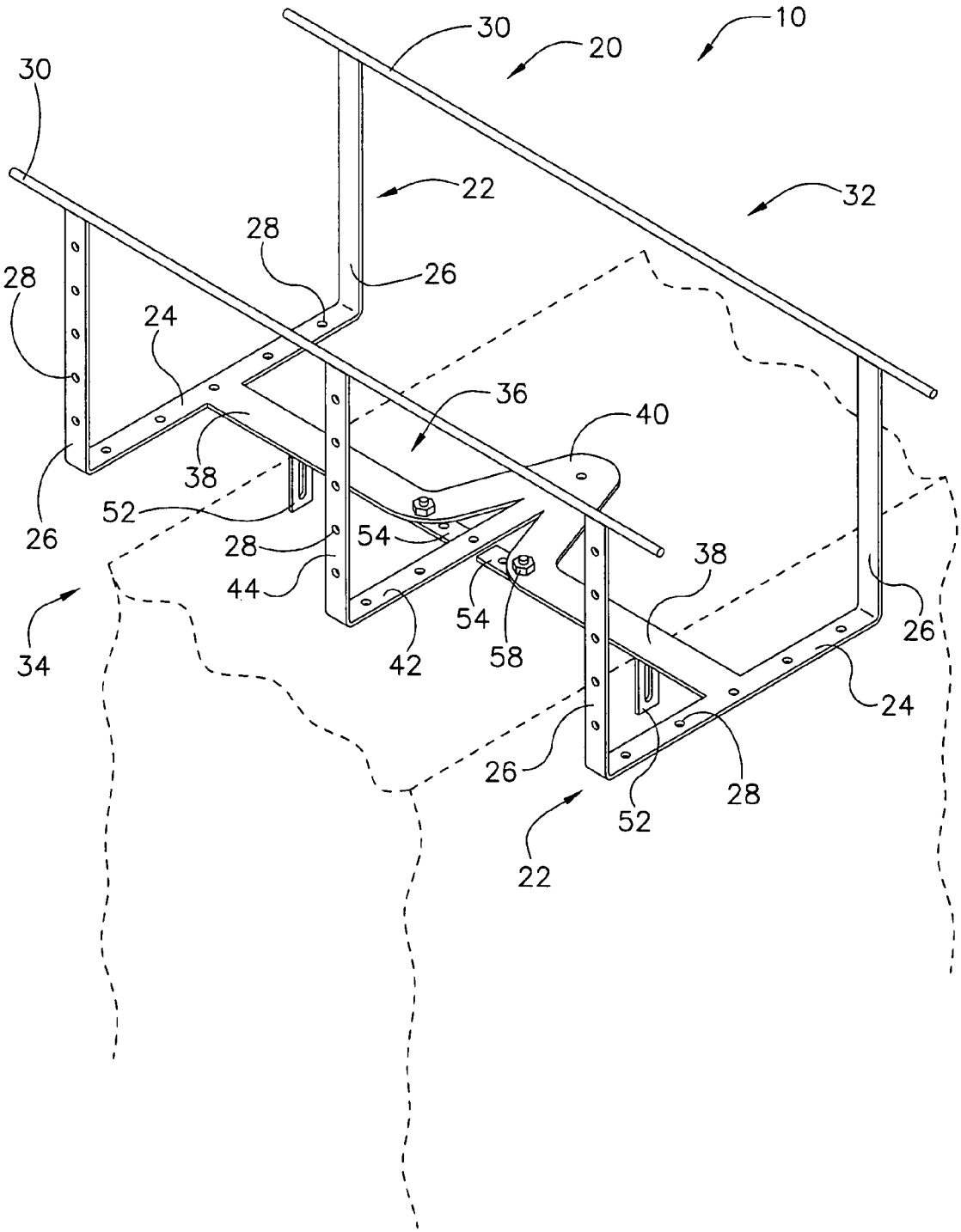
FIG. 2 is a schematic image of a perspective view of one mounting arrangement for the adaptable planter mounting system according to the embodiment of FIG. 1.

Referring to FIG. 2, a mounting arrangement for use with a wall-top structure is shown according to an exemplary embodiment, where the longitudinal axis of the planter 12 is oriented transverse to the wall. A pair of brackets 50 are provided with their second legs 54 attached to (and extending parallel with) the platform base 38 with the first legs 52 oriented to engage (e.g. grip, compress, contact, etc.) opposite sides of the wall. The slots 56 in the second legs 54 of the brackets 50 permit the space between the first legs 52 to be selectively adjusted and then "locked-in" by the fasteners (or snap-connect features—not shown) to accommodate walls of various thicknesses.

Figure 3:
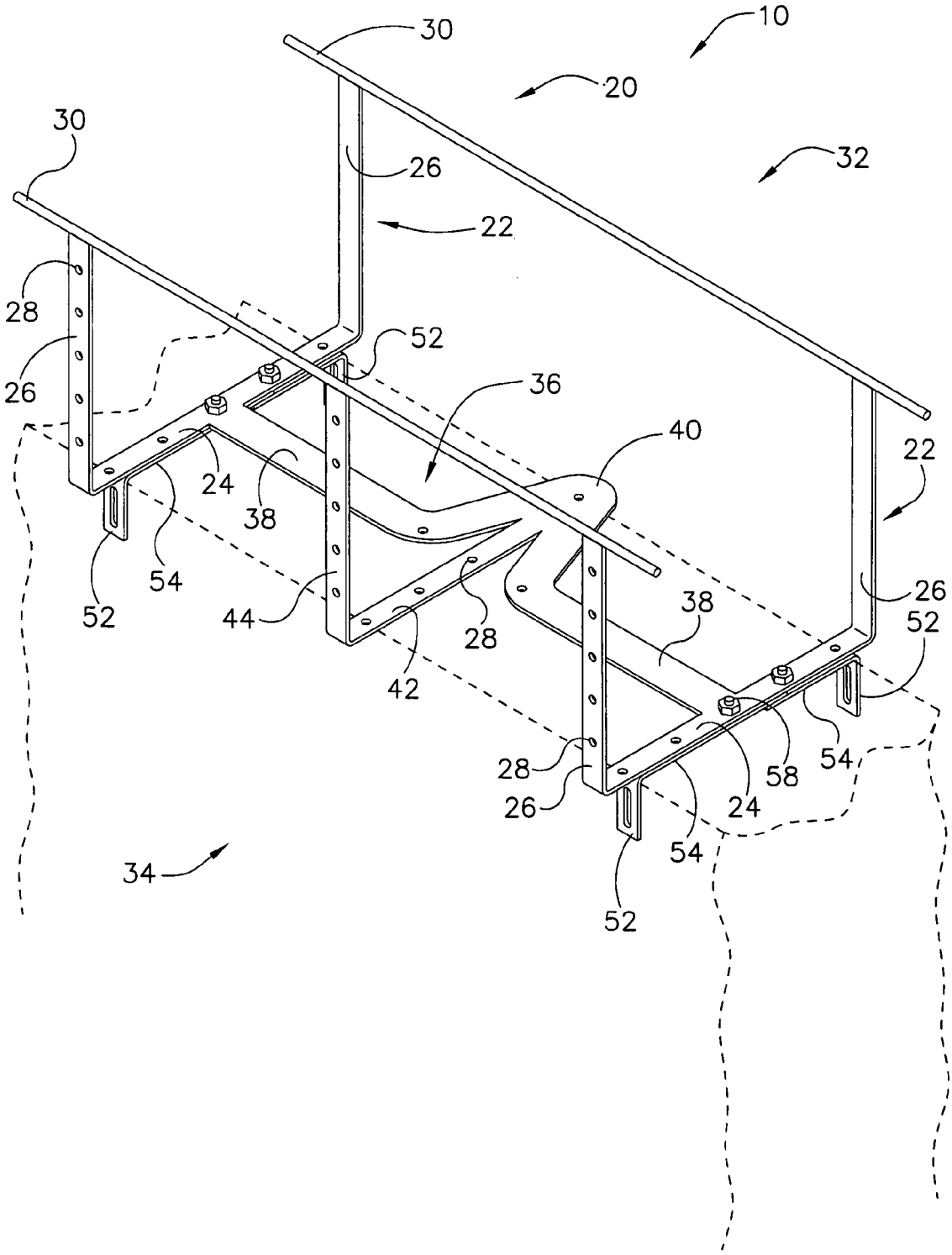
FIG. 3 is a schematic image of a perspective view of another mounting arrangement for the adaptable planter mounting system according to the embodiment of FIG. 1.

Referring to FIG. 3, a mounting arrangement for use with a wall-top structure is shown according to an exemplary embodiment, where the longitudinal axis of the planter 12 is oriented longitudinally with the wall. Two pairs of brackets 50 are provided with their second legs 54 attached to (and extending parallel with) the base of each U shaped support 22 with the first legs 52 oriented to engage (e.g. grip, compress, contact, etc.) opposite sides of the wall. The slots 56 in the second legs 54 of the brackets 50 permit the space between the first legs 52 to be selectively adjusted and then "locked-in" by the fasteners (or snap-connect features—not shown) to accommodate walls of various thicknesses.

Figure 4:
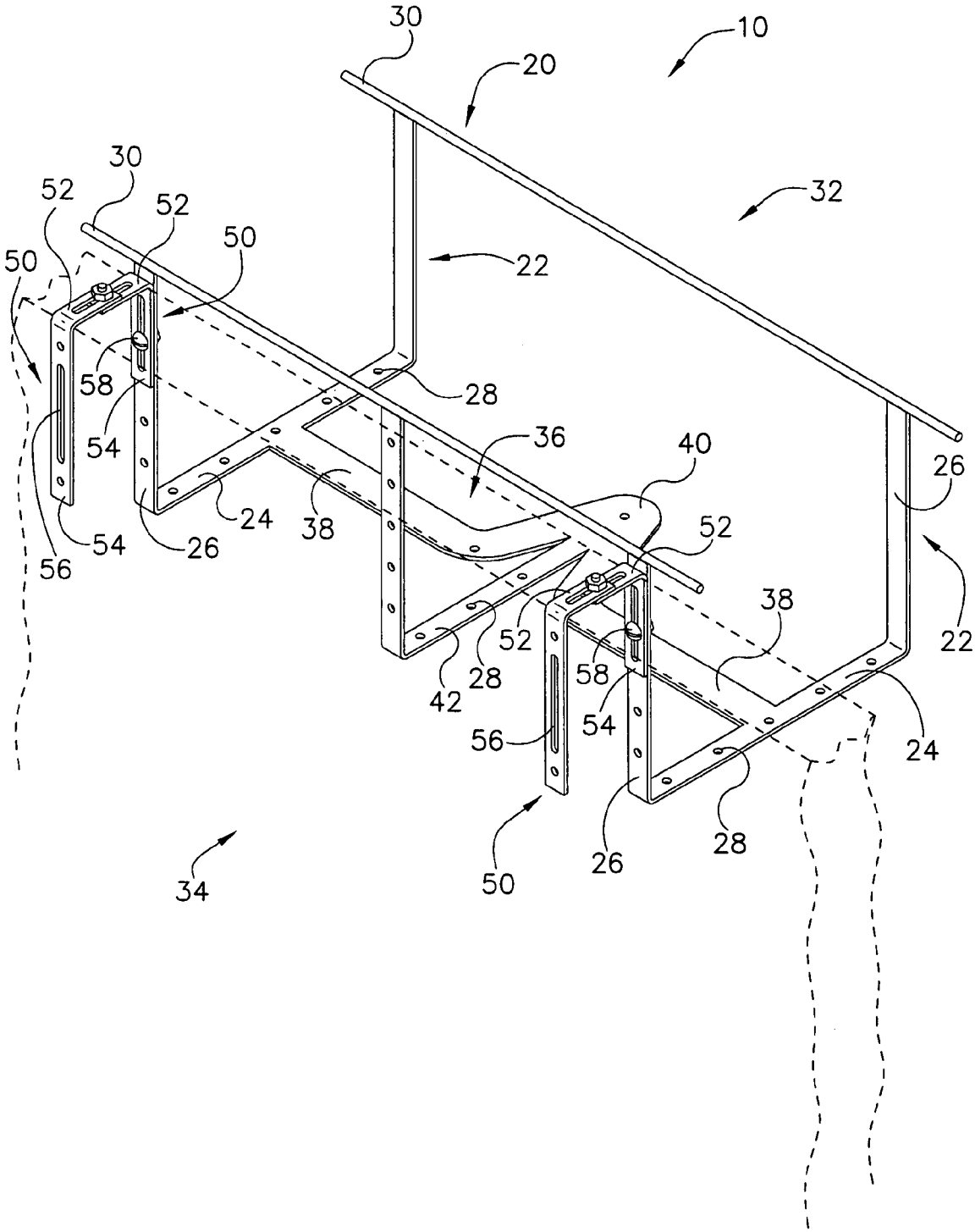
FIG. 4 is a schematic image of a perspective view of another mounting arrangement for the adaptable planter mounting system according to the embodiment of FIG. 1.

Referring to FIG. 4, a mounting arrangement for use with a rail in a hanging application ("rail-hang") is shown according to an exemplary embodiment. A pair of brackets 50 are provided with their first legs 52 coupled together to create a U shaped hook that is mountable over the top of the rail, and each pair of brackets 50 having a second leg 54 attached to (and extending parallel with) an arm 26 of each U shaped support 22. The slots 56 shown in the first legs 52 of the brackets 50 permit the space between the second legs 54 to be selectively adjusted and then "locked-in" by the fasteners (or snap-connect features—not shown) to accommodate rails of various thicknesses.

Figure 5:
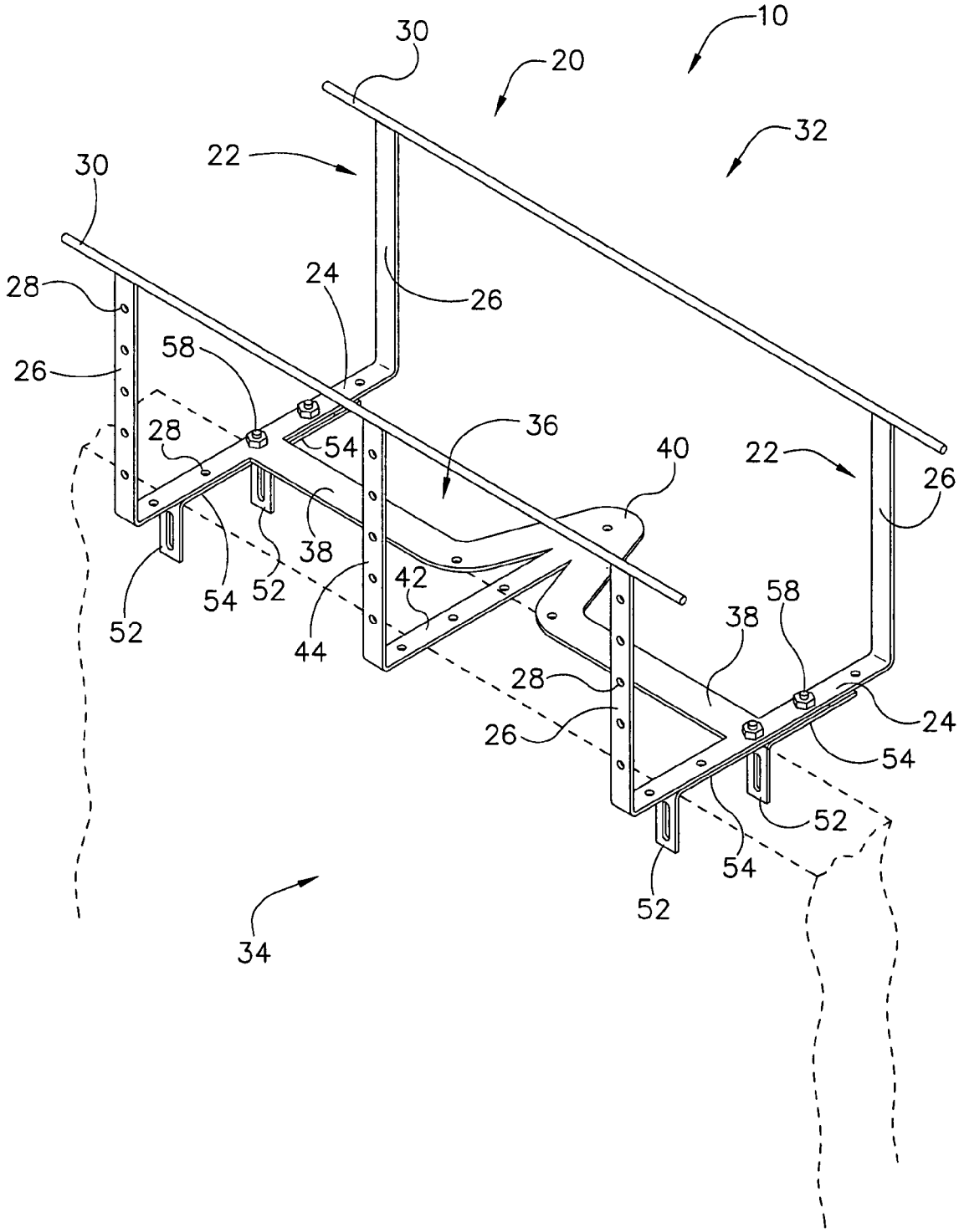
FIG. 5 is a schematic image of a perspective view of another mounting arrangement for the adaptable planter mounting system according to the embodiment of FIG. 1.

Referring to FIG. 5, a mounting arrangement for use in a rail-top application is shown according to an exemplary embodiment. Two pair of brackets 50 are provided with their second legs 54 overlapping and coupled together and coupled to a base 24 of each U shaped support 22 to capture the rail between the first legs 52 of each bracket pair. The slots 56 shown in the second legs 54 of the brackets 50 permit the space between the first legs 52 to be selectively adjusted and then "locked-in" by the fasteners (or snap-connect features—not shown) to accommodate rails of various thicknesses.

Figure 6:
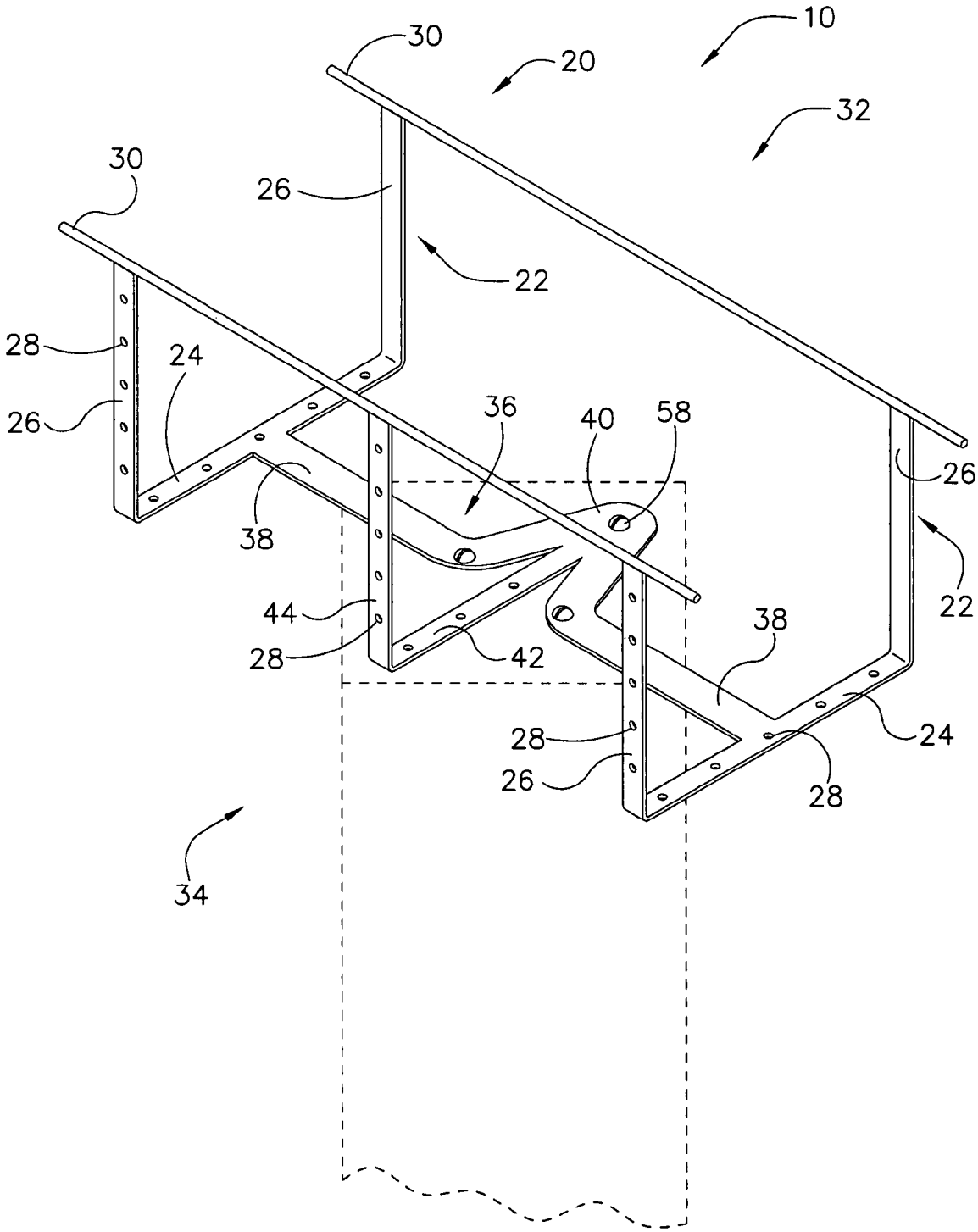
FIG. 6 is a schematic image of a perspective view of another mounting arrangement for the adaptable planter mounting system according to the embodiment of FIG. 1.

Referring to FIG. 6, a mounting arrangement for use in a post-top application is shown according to an exemplary embodiment. The V shaped region 40 on the platform section 36 of the holder 20 provides a stable base for attachment to a post-top. Additional support and stability may be provided by connecting L shaped brackets to each base 24 so that a leg of each bracket engages (e.g. grips, compresses, contacts, etc.) opposite sides of the post.

Figure 7:
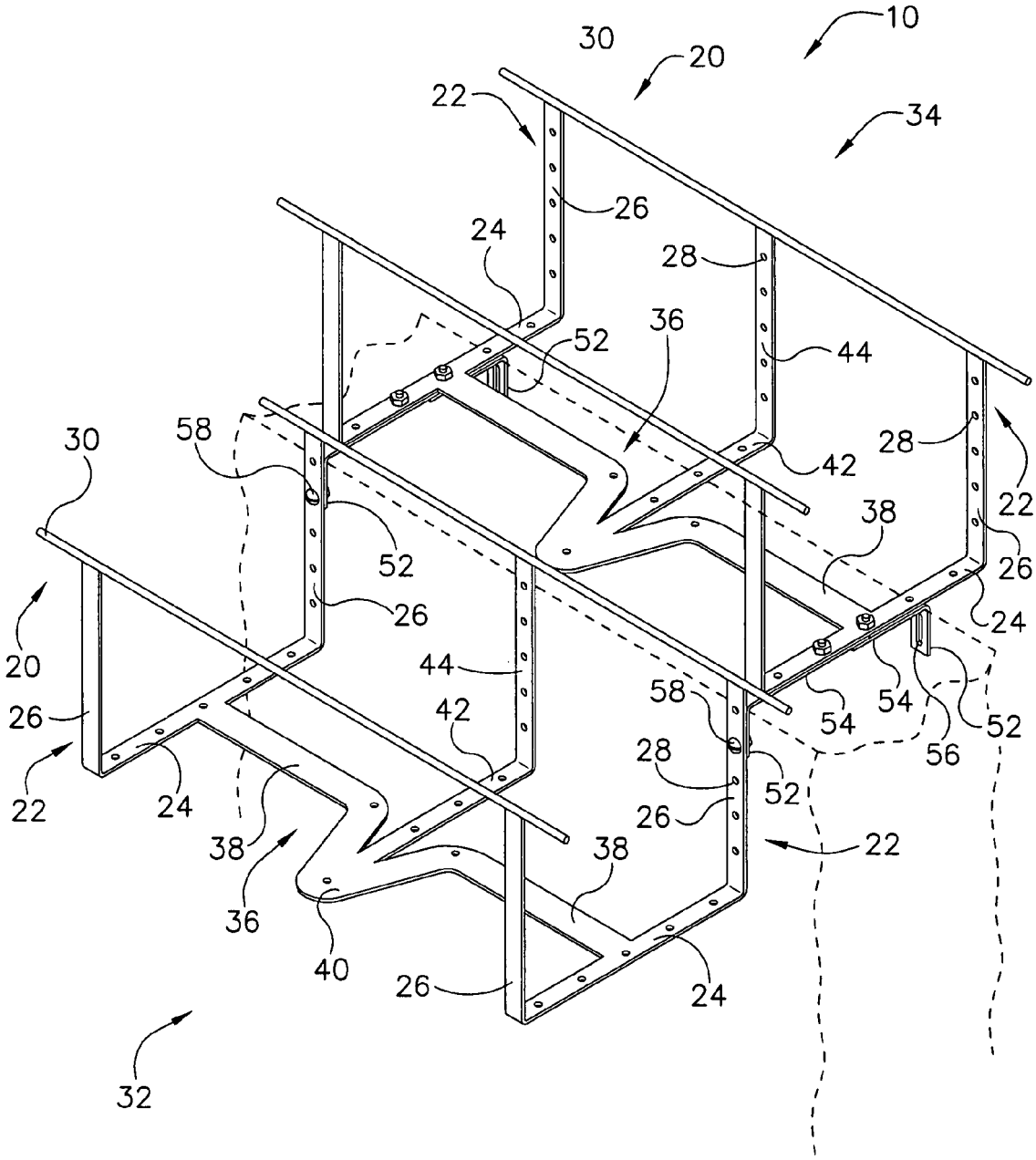
FIG. 7 is a schematic image of a perspective view of another mounting arrangement for the adaptable planter mounting system according to the embodiment of FIG. 1.

Referring to FIG. 7, a mounting arrangement for use in connecting two or more holders 20 together in a stepped application and for mounting one of the holders 20 (shown as an "upper" holder) to a structure (shown for example as a wall-top, but may also be a rail top or post-top) is shown according to an exemplary embodiment. Two pair of brackets 50 are provided with their second legs 54 attached to (and extending parallel with) the base 24 of each U shaped support 22 on a first (shown as a "top") holder 20, with the first legs 52 oriented to engage (e.g. grip, compress, contact, etc.) opposite sides of the wall. The slots 56 in the second legs 54 of the brackets 50 permit the space between the first legs 52 to be selectively adjusted and then "locked-in" by the fasteners (or snap-connect features—not shown) to accommodate walls of various thicknesses. The first legs 52 facing the front of the holder 20 may also be connected to the arms 26 extending along the back of a second holder 20 to create a stepped (e.g. tiered, cascaded, etc.) arrangement of planters 12. Likewise, additional holders may be connected in a stepwise arrangement as described above.

Figure 8:
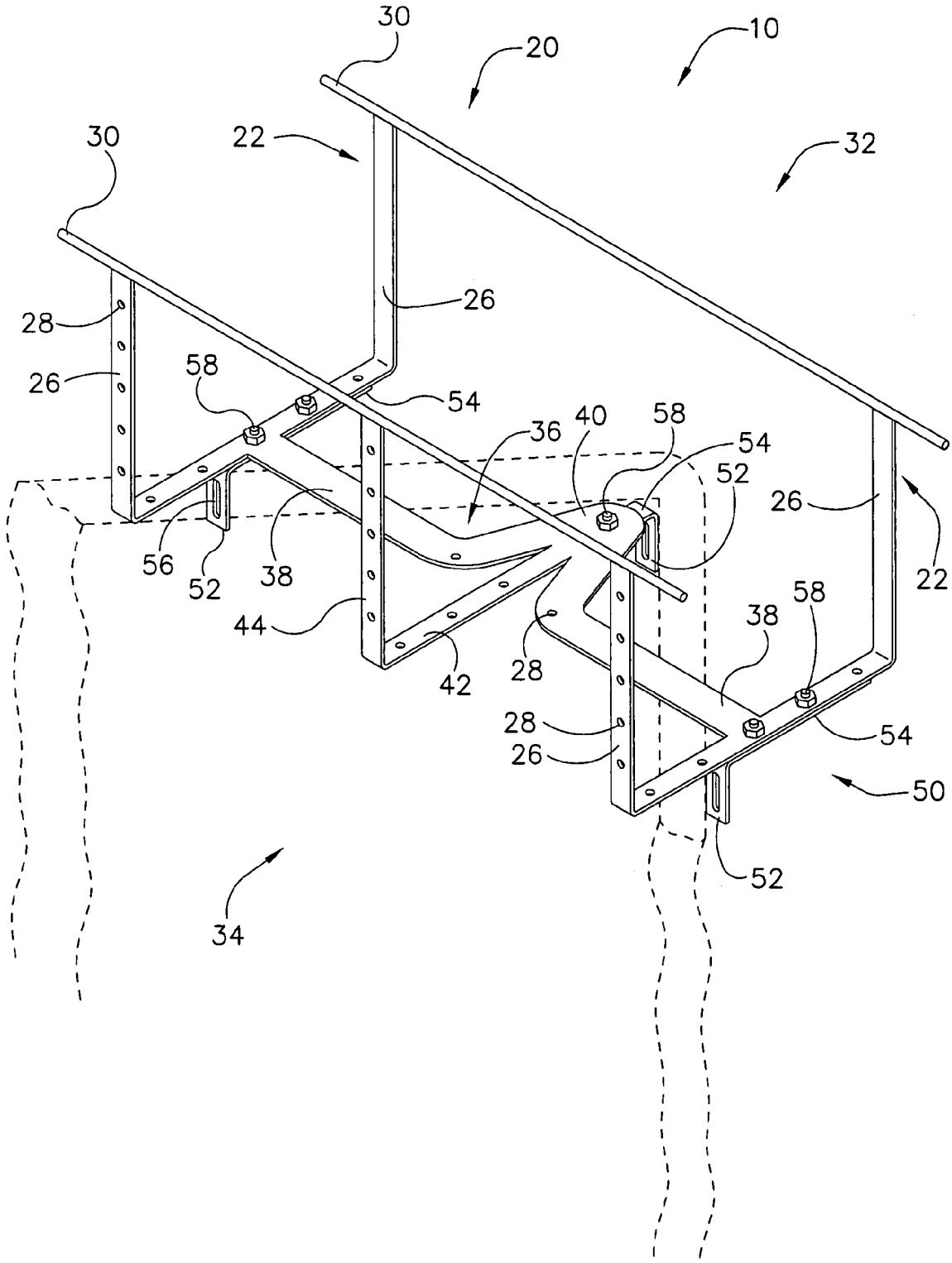
FIG. 8 is a schematic image of a perspective view of another mounting arrangement for the adaptable planter mounting system according to the embodiment of FIG. 1.

Referring to FIG. 8, a mounting arrangement for use in a corner configuration (e.g. of a rail, wall, fence, etc.) is shown according to an exemplary embodiment. One L shaped bracket 50 is attached to each base 24 and to the V shaped region 40 so that the corner is captured (e.g. wedged, compressed, etc.) between the brackets. For example, as illustrated, the brackets 50 connected to the bases 24 may bear on the outside of the corner and the bracket 50 connected to the V shaped region 40 may bear on the inside of the corner. Alternatively, the orientation of the brackets with respect to the corner structure may be reversed.

According to any exemplary embodiment, an adaptable mounting system for a planter includes a holder having a frame that is suitable for holding and securing a container such as a flowerbox or planter. The holder has apertures provided at predetermined locations that are arranged to adjustably connect with one or more brackets, or pairs of brackets that are configured to releasably engage a structure (e.g. wall, post, fence, railing, another holder, etc.) to provide a readily adaptable system for mounting a planter in a wide variety of mounting arrangements. The brackets may be L shaped, or any other shape intended to enhance the universal and interchangeable ability of the system to adapt to various structures. The platform is shown to include a central region having a stability-enhancing extension (shown for example as a V shape), however, any other shape may be used to enhance the stability of the holder for use in mounting to a variety of structures. Apertures are shown on the arms extending from the back side of the U shaped members, but may also be provided along the arms extending from the front side of the U shaped members.

It is also important to note that the construction and arrangement of the elements of the adaptable planter mounting system as shown schematically in the embodiments is illustrative only. Although only a few embodiments have been described in detail in this disclosure, those skilled in the art who review this disclosure will readily appreciate that many modifications are possible without materially departing from the novel teachings and advantages of the subject matter recited.

Accordingly, all such modifications are intended to be included within the scope of the present inventions. Other substitutions, modifications, changes and omissions may be made in the design, shape, orientation, and arrangement of the preferred and other exemplary embodiments without departing from the spirit of the present invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present invention as expressed in the appended claims.

What is claimed is:

1. An adaptable planter mounting system, comprising:

a holder comprising:

first and second U shaped supports configured to support a planter, each U shaped holder having a substantially horizontal base with a plurality of apertures, and first and second arms extending upwardly from opposite ends of the base, at least one of the arms having a plurality of apertures;

a first elongated member interconnecting the first arms of the U shaped supports and a second elongated member interconnecting the second arms of the U shaped supports;

a platform interconnecting the bases of the U shaped holders, the platform including a plurality of apertures; and first and second L shaped brackets each having a first leg and a second leg, the first legs each having an elongated aperture formed therein, the elongated aperture of the first legs being aligned with at least one of the apertures on one or more of the base, the platform and the arms to adjustably and removably connect the first and second L shaped brackets to the holder, so that holder is configured for mounting on a support structure, wherein the platform further comprises a V shaped region having at least one aperture.

2. The system of claim 1 further comprising an L shaped member interconnecting the V shaped region of the platform with at least one of the first and second elongated members.

3. The system of claim 2 wherein the base of the U shaped holders and the platform and the V shaped region and a leg of the L shaped member are substantially coplanar and configured to support an underside of the planter.

4. The system of claim 1 further comprising third and fourth L shaped brackets each having a first leg and a second leg, the first legs each having an elongated aperture formed therein, the elongated aperture of the first legs being aligned with at least one of the apertures on one or more of the base, the platform and the arms to adjustably and removably connect the third and fourth L shaped brackets to the holder.

5. The system of claim 1 wherein the first leg of each L shaped bracket is positionable in an orientation parallel to the platform.

6. The system of claim 1 wherein the first leg of each L shaped bracket is positionable in an orientation parallel to the base of the U shaped members.

7. The system of claim 1 wherein the first leg of each L shaped bracket are positionable in an orientation that at least partially overlap one another.

8. The system of claim 1 wherein the first and second elongated members are configured to be received within an overhang region of the planter.

9. The system of claim 1 further comprising a second holder connectable to the first holder in a stepped orientation by a pair of L shaped brackets.

10. The system of claim 1 wherein the second leg of the L shaped brackets include apertures for connecting the second legs of the L shaped brackets together in a U shaped arrangement having a variable width.

11. An adaptable planter mounting system, comprising:

a holder, the holder including:

spaced apart first and second U shaped supports configured to support a planter, each U shaped support having a substantially horizontal base with a plurality of apertures, and first and second arms extending upwardly from the base, at least one of the arms having a plurality of apertures;

a first elongated member interconnecting the first arms;

a platform interconnecting the bases of the U shaped supports, the platform including a central region with an extension and a plurality of apertures; and at least two L shaped brackets each having a first leg and a second leg, at least one of the legs for each bracket having an elongated aperture formed therein, the elongated aperture being aligned with at least one of the apertures on the base, or the platform, or the arms to adjustably and removably connect the L shaped brackets to the holder, so that holder is configured for mounting on a support structure wherein the extension comprises a V shaped extension.

12. The system of claim 11 further comprising a second elongated member interconnecting the second arms of the U shaped supports.

13. The system of claim 12 wherein the arms have substantially equal length and the first and second elongated members define a plane that is substantially parallel to a plane defined by the bases of the U shaped supports.

14. An adaptable planter mounting system, comprising:

a holder having a platform and at least two pairs of arms configured to support the planter, the platform and at least one of the arms having apertures;

at least one pair of brackets adjustably and removably attachable to at least one of the platform and the arms to provide a plurality of mounting arrangements including a Stepped mounting arrangement, a rail mounting arrangement, and a wall-top mounting arrangement wherein the platform comprises a V shaped region.

15. The system of claim 14 wherein the mounting arrangements further comprise a corner-mounting arrangement.

16. The system of claim 14 wherein the brackets comprise L-shaped brackets having slots, the slots providing a range of adjustable positions for attaching the brackets to the holder.

17. The system of claim 14 wherein the wall-top mounting arrangement comprises a longitudinal wall-top mounting arrangement and a transverse wall-top mounting arrangement.

18. The system of claim 14 wherein the pair of arms and at least a portion of the platform form a U-shaped support member.

19. The system of claim 14 wherein the brackets are engageable with the holder in a snap-connect relationship.

* * * * *